US011806636B1

(12) United States Patent
Bland et al.

(10) Patent No.: US 11,806,636 B1
(45) Date of Patent: Nov. 7, 2023

(54) CONTROLLABLE KITE CONFIGURATION

(71) Applicant: United States of America as represented by the Administrator of NASA, Washington, DC (US)

(72) Inventors: Geoffrey Bland, Assawoman, VA (US); Joseph Bretthauer, Silver Spring, MD (US); Ted Miles, Onancock, VA (US); Kay Rufty, Boulder, CO (US); Douglas Stout, Byram Township, NJ (US); Richard Cairncross, Philadelphia, PA (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 17/944,345

(22) Filed: Sep. 14, 2022

(51) Int. Cl.
*A63H 27/08* (2020.01)
*A63H 27/00* (2006.01)

(52) U.S. Cl.
CPC ..... *A63H 27/002* (2013.01); *A63H 27/08* (2013.01)

(58) Field of Classification Search
CPC ..... A63H 27/002; A63H 27/08; B64U 10/50; B64U 10/60
See application file for complete search history.

(56) References Cited

U.S. PATENT DOCUMENTS 1,620,882 A * 3/1927 Founds ..... A63H 27/08 244/154
1,857,687 A * 5/1932 Ikerman ..... B64C 11/00 244/154
5,931,416 A * 8/1999 Carpenter ..... A63H 30/02 244/155 A
8,196,853 B2 * 6/2012 Bland ..... B64C 39/022 244/1 R

* cited by examiner

*Primary Examiner* — J. Woodrow Eldred
(74) *Attorney, Agent, or Firm* — Christopher O. Edwards; Matthew F. Johnston; Trenton J. Roche

(57) ABSTRACT

Embodiments may provide a kite system that incorporates a highly efficient lifting surface combined with aerodynamic control surfaces while using only a single tether. Such a kite having a lifting surface combined with aerodynamic control surfaces while using only a single tether may be referred to as a "controllable kite". Embodiments may include a controllable kite configured to operate aloft connected to only a single tether, the kite including a lifting surface that is heavier-than-air, an aerodynamic surface control system configured to adjust an attitude of the lifting surface while the kite is aloft, and an attachment point connecting the single tether to the kite.

13 Claims, 4 Drawing Sheets

CONTROLLABLE KITE CONFIGURATION

ORIGIN OF THE INVENTION

The invention described herein was made in performance of work under a NASA contract and by an employee of the United States Government and is subject to Public Law 96-517 (35 U.S.C. §200 et seq). The contractor has not elected to retain title to the invention.

FIELD OF THE INVENTION

The present invention relates to kite configuration and control, and more specifically to a controllable single tether kite system.

BACKGROUND OF THE INVENTION

Current practice for using tethered flight systems, i.e., kites, as aerial measurement or observations systems includes the use of a more or less traditional kite (sometimes referred to as a "pilot kite") for lifting the flight line (or tether), and an instrumentation package attached to the flight line. In current kite systems, additional flight lines (or tethers) are added to the kite to adjust the positioning of the kite. For example, sport and stunt kite configurations use two or more additional flight lines (or tethers) to enable aerodynamic properties of the kite to be changed. While additional flight lines (or tethers) can support kite positioning adjustments, the addition of any additional lines (or tethers) beyond the single required flight line (or tether) for a kite increases aerodynamic draft and presents challenges in handling multiple lines. Thus, a need exists for a tethered flight system (i.e., a kite) that incorporates a highly efficient lifting surface combined with aerodynamic control surfaces while using only a single flight line (or tether).

SUMMARY

The various embodiments may provide a tethered flight system (i.e., a kite) that incorporates a highly efficient lifting surface combined with aerodynamic control surfaces while using only a single flight line (or tether). Such a kite having a lifting surface combined with aerodynamic control surfaces while using only a single flight line (or tether) may be referred to as a "controllable kite". In various embodiments, a controllable kite may include instruments thereon and may change altitude to position the instruments at different altitudes above the ground. In some embodiments, a controllable kite may additionally operate as a controllable pilot kite to support one or more sensors along the single flight line (or tether).

The various embodiments may provide a kite system, comprising: a single tether; and a kite configured to operate aloft connected to only the single tether, the kite comprising: a lifting surface, wherein the lifting surface is heavier-than-air; an aerodynamic surface control system configured to adjust an attitude of the lifting surface while the kite is aloft; and an attachment point connecting the single tether to the kite.

The various embodiments may provide a kite system, comprising: a single tether; and a kite configured to operate aloft connected to only the single tether, the kite comprising: a lifting surface, wherein the lifting surface is a wing that is heavier-than-air; an aerodynamic surface control system configured to adjust an attitude of the lifting surface while the kite is aloft; an instrument system configured to gather data while the kite is aloft and an attachment point connecting the single tether to the kite.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION OF THE INVENTION

Figure 1:
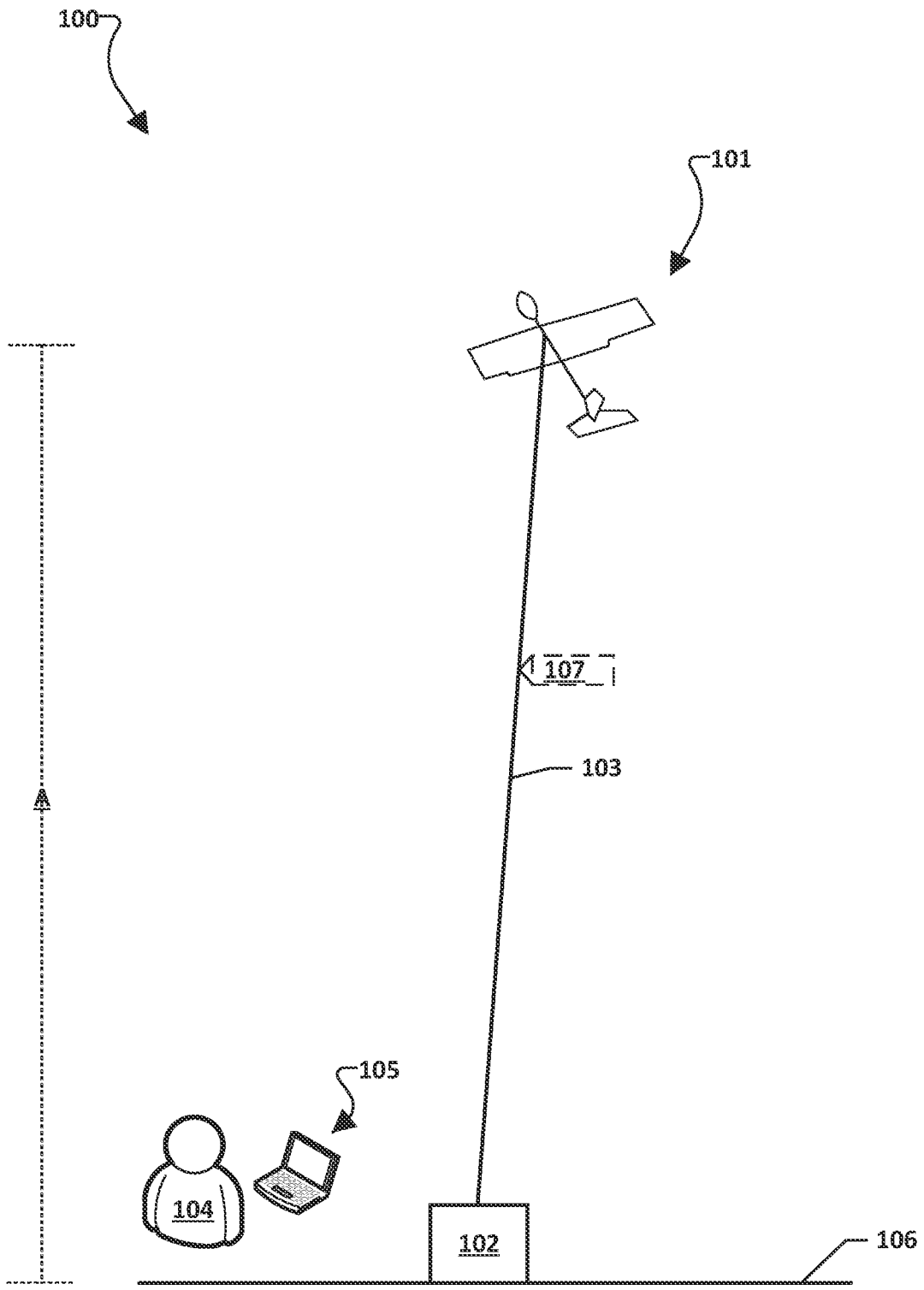
FIG. 1 is a component block diagram of an embodiment tethered flight system having a kite include a lifting surface combined with aerodynamic control surfaces while using only a single flight line (or tether).

For purposes of description herein, it is to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

As used herein the term "kite" refers to a heavier-than-air device that is held aloft (i.e., above the ground) by at least a combination of lift force from fluid flow over the kite's surface(s) and a tension force from a tether (or flight line) acting on the kite. The term "heavier-than-air" as used herein is intended to mean a component weighs more than the fluid it displaces, and is not intended to be limited to any specific atmospheric composition.

Terms such as "heavier-than-air", "ground", "surface", etc., are not intended to limit the various embodiments to usage on Earth, and the kites and kite systems discussed herein may be applicable to usage on planets other than Earth having an atmosphere and/or moons having an atmosphere. As such, the various embodiments may find applicability in both terrestrial and interplanetary exploration and measurement.

Various embodiments may provide a tethered flight system (i.e., a kite) that incorporates a highly efficient lifting surface combined with aerodynamic control surfaces while using only a single flight line (or tether). Such a kite having a lifting surface combined with aerodynamic control surfaces while using only a single flight line (or tether) may be referred to as a "controllable kite". In various embodiments, a controllable kite may include a lifting surface, such as a rigidly constructed wing, a single surface sail, etc. and one or more aerodynamic control surfaces configured for changing the flight attitude of the lifting surface (and/or the controllable kite itself), and a location for attaching a flight line (also referred to as a tether or tow line). In various embodiments, a controllable kite may be controllable in the pitch axis for lift and drag control via an elevator control surface. In optional embodiments, the controllable kite may include a tail. The tail may provide control in the directional axis (e.g., via a rudder) and/or lateral control (e.g., via ailerons, flaps, dihedral effect, etc.). Additionally, a tail may provide a moment arm that may provide aerodynamic benefit. In some embodiments, a controllable kite may optionally include a variable bridle that may provide control of the flight attitude of the controllable kite, and thereby the lifting surface. As used herein, the term "flight attitude" means orientation of the controllable kite (particularly pitch angle) with respect to the horizontal plane or with respect to the wind.

In various embodiments, a controllable kite may include instruments thereon and may change altitude to position the instruments at different altitudes above the ground. In various embodiments, a controllable kite may be suitable for integration of in-situ and/or remote sensing instrumentation, thus eliminating the requirement for separate pilot kites and sensors suspended from the tether. Instrumentation may include sensors for wind speed and direction, pressure, Global Positioning System (UPS), temperature, humidity, imagers, atmospheric particle detectors, and/or gas detectors. In some embodiments, a controllable kite may additionally operate as a controllable pilot kite to support one or more sensors along the single flight line (or tether).

In various embodiments, an aerodynamic surface control system of a controllable kite may control one or more aerodynamic control surfaces, and/or, optionally a variable bridle, to position the controllable kite. For example, an aerodynamic surface control system of a controllable kite may control one or more aerodynamic control surfaces, and/or, optionally a variable bridle, such that the controllable kite may be pointed into the wind, the controllable kite may be pointed ninety degrees to the wind, the controllable kite may be maintained level to the ground, the controllable kite may climb, the controllable kite may descend, the controllable kite may keep station at a set altitude, etc. As a controllable kite may be independently controlled, the positioning of the controllable kite may be wind relative rather than ground relative.

The various embodiments may provide a kite system, comprising: a single tether; and a kite configured to operate aloft connected to only the single tether, the kite comprising: a lifting surface, wherein the lifting surface is heavier-than-air; an aerodynamic surface control system configured to adjust an attitude of the lifting surface (e.g., a pitch angle of the lifting surface) while the kite is aloft; and an attachment point connecting the single tether to the kite FIG. 1 is a component block diagram of an embodiment tethered flight system 100 (or kite system 100). The kite system 100 may include a controllable kite 101, a tether 103 flight line 103), and an anchor system 102, such as a winch, spindle, reel, clip, etc. The anchor system 102 may be positioned on a surface 106, such as planetary surface (e.g., the surface of Earth or the surface of another planet), a structural surface (e.g., a roof, a ship, a tower, etc.) or any other type surface. The tether 103 may be a cable, a wire, a line, etc., connected between an attachment point of the kite 101 and the anchor system 102. The kite 101 may be aloft at an altitude "A" above the surface 106.

In an optional embodiment, a suspended instrument system 107 may be affixed to the tether 103. The suspended instrument system 107 may be an instrument system configured to gather data while the kite 101 is aloft. For example, the suspended instrument system 107 may be an instrument platform such as that described in U.S. Pat. No. 8,196,853 to Bland et al, which is herein incorporated by reference in its entirety for all purposes. As another example, the suspended instrument system 107 may be an instrument platform that is a line climber type system that moves along the tether 103. Instrumentation in the suspended instrument system 107 may include sensors for wind speed and direction, pressure, Global Positioning System (UPS), temperature, humidity, imagers, atmospheric particle detectors, gas detectors, and/or sensors for performance of the kite 101 (e.g., accelerometers, gyroscopes, magnetometers, flex sensors, stress sensors, etc.).

The kite 101 may be configured to operate aloft at the altitude "A" connected to only the single tether 103. Said another way, the kite 101 may not be a multiple line or tether kite. Rather, only the one single tether 103 may be connected to the kite 101.

In some embodiments, an operator 104 of the kite 101 and kite system 100 may interact with the kite 101 via a command and control system 105. The command and control system 105 may wirelessly communicate with the kite 101 and/or the suspended instrument system 107 to receive data from the instruments on the kite 101 and/or the suspended instrument system 107. The command and control system 105 may wirelessly communicate with the kite 101 to set the altitude "A" at which the kite 101 may be aloft. The kite 101 may operate at various different altitudes and the value of "A" may be from a few feet above the surface 106 to many thousands of feet, such as 18,000 feet above the surface 106 or higher.

Figure 2:
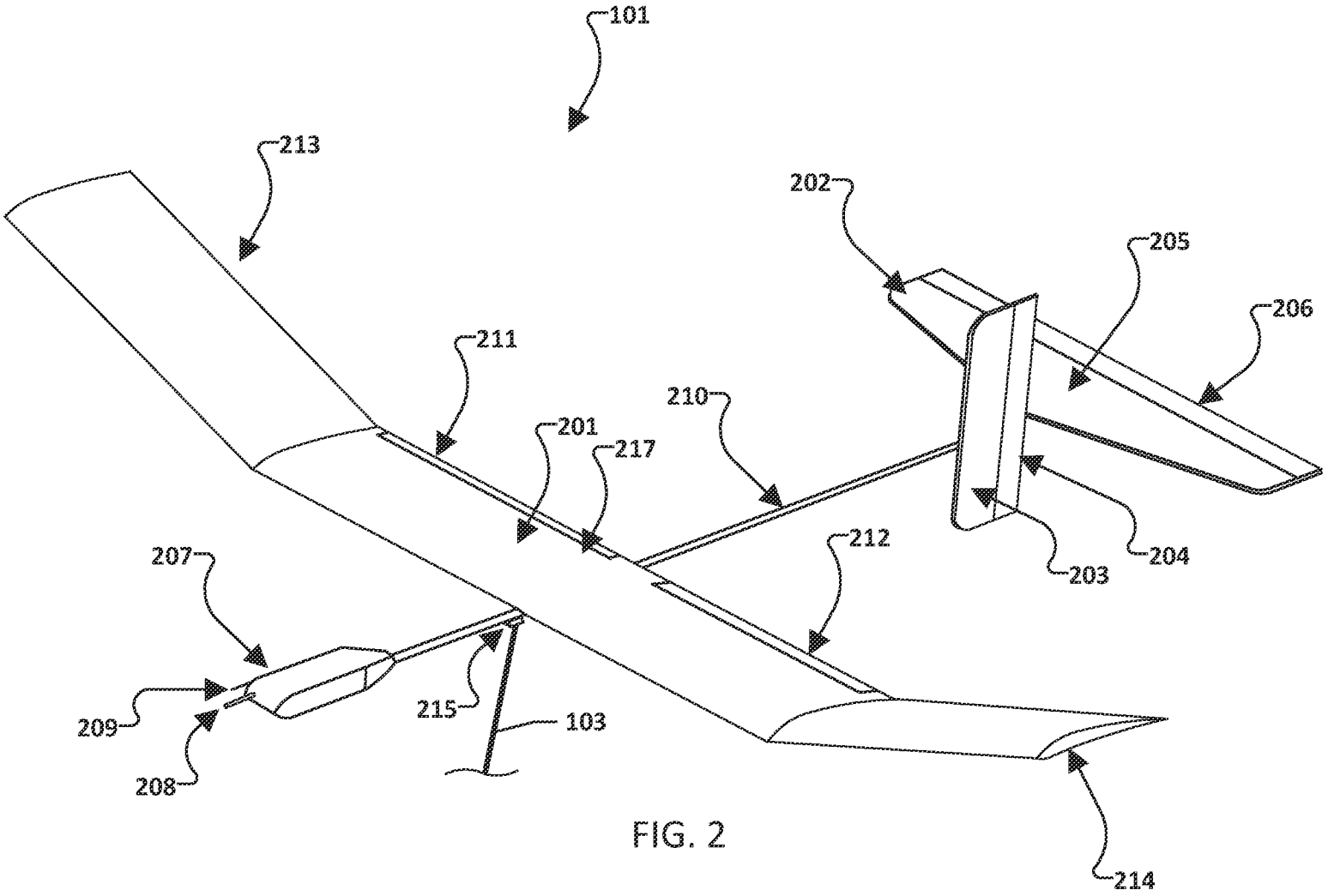
FIG. 2 is a block diagram of an embodiment controllable kite having a lifting surface combined with aerodynamic control surfaces while using only a single flight line (or tether).

FIG. 2 is an example of the controllable kite 101 having a lifting surface combined with aerodynamic control surfaces while using only the single tether 103. With reference to FIGS. 1-2, the kite 101 may include a lifting surface, such as a wing 201. The wing 201 may be a heavier-than-air structure that produces lift as fluid flows over the wing 201. The wing 201 may be a rigid structure having two surfaces over which fluid flows. For example, the wing 201 may be a have internal framing and external surface fabric stretched over that framing that gives the wing 201 its shape and rigidity. The kite 101 may include a fuselage 210 supporting various elements of the kite 101. The kite 101 may include an attachment point 215, such as a ring, clip, clap, joint, etc., connecting the single tether 103 to the kite 101.

The kite 101 may include a housing 207 connected to the fuselage 210. The housing 207 may include various features extending from the housing, such as an antenna 209 and/or sensor probe 208, such as a Pitot tube or other extended sensor. While the housing 207 is illustrated as extended away from the wing 201 in FIG. 2, the relative position of the housing 207 and wing 201 may vary in the various embodiments. Additionally, in some embodiments, the housing 207 may not be required and various features of the housing 207 may be built into the wing 201 itself.

In some embodiments, the wing 201 may he a rectangular wing section 217 with dihedral end sections 213 and 214. While the wing 201 is illustrated with a rectangular wing section 217 with dihedral end sections 213 and 214 in FIG. 2, the wing 201 may vary in shape and/or design.

In some embodiments, the wing 201 may include one or more aerodynamic control surfaces, such as flaps 211 and 212. Flaps 211 and 212 may be a portion of an aerodynamic surface control system configured to adjust an attitude of the wing 201 (e.g., a pitch angle of the wing 201 with respect to the surface 106) while the kite 101 is aloft. In some embodiments, the flaps 211 and 212 may be controlled together to move relative to the wing 201 in the same direction and speed to change the lift and drag of the wing 201, thereby changing the attitude of the wing 201. Additionally, the wing 201 may include additional aerodynamic control surfaces, such as ailerons, spoilers, and slats.

In some embodiments, the kite 101 may optionally include a tail structure 202. The tail structure 202 may be optional, and a kite 101 may not include a tail structure 202 in all configurations. When the tail structure 202 is present, the tail structure 202 may provide benefits as a moment arm to aid control and/or stability. FIG. 2 illustrates one configuration of a tail structure 202 and other tail structures configurations may be substituted for the tail structure 202. The tail structure 202 may include a vertical surface 203 and a horizontal surface 205. The vertical surface 203 may include a directional control surface 204, such as a rudder. The horizontal surface 205 may include a lateral control surface 206, such as a tail flap or elevator. The directional control surface 204 may be controlled by the aerodynamic surface control system to adjust a yaw of the kite 101 around the kite's 101 vertical axis. The lateral control surface 206 may be controlled by the aerodynamic surface control system to adjust the pitch of the kite 101 around the kite's 101 lateral axis.

Figure 3:
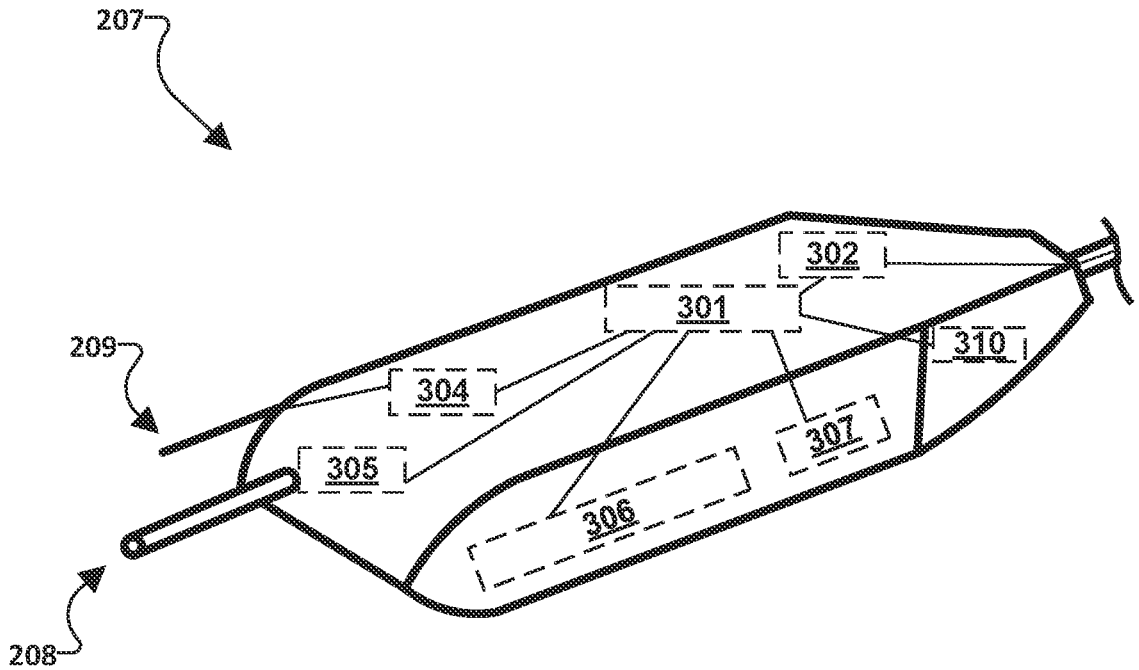
FIG. 3 is a block diagram of a portion of an embodiment kite showing example internal systems in accordance with various embodiments.

FIG. 3 block diagram of a portion of the housing 207 of the kite 101 showing example internal systems in accordance with various embodiments. With reference to FIGS. 1-3, the housing 207 may include a controller 301, such as a processor, microcontroller, etc., configured to control various systems and components of the kite 101. The controller 301 may be connected to a power system 307, such as a battery, within the housing 207. While illustrated as within the housing 207, the power system 307 may be located in other portions of the kite 101, such as in the wing 201. The controller 301 may be connected to one or more actuators 302, such as motors, drivers, etc., that may cause the one or more aerodynamic control surfaces, such as flaps 211 and 212, directional control surface 204, and/or lateral control surface 206 to move. While illustrated as within the housing 207, the one or more actuators 302 may be located in other portions of the kite 101, such as in the wing 201, on the tail structure 202, etc.

The controller 301 may be connected to one or more instrument systems 305 and/or 306. Some instrument systems may be entirely internal to the housing 207, such as instrument system 306. Other instrument systems, such as instrument systems 305, may be partially and/or entirely external to the housing 207 and/or connected to portions external to the housing 207, such as the sensor probe 208. The instrument systems 305 and/or 306 may include sensors for wind speed and direction, pressure, Global Positioning System (GPS), temperature, humidity, imagers, atmospheric particle detectors, and/or gas detectors. While illustrated as within the housing 207, the instrument systems 305 and/or 306 may be located in other portions of the kite 101, such as in the wing 201, fuselage 210, etc. The controller 301 may send and/or receive data to/from the one or more instrument systems 305 and/or 306.

The controller 301 may be connected to a radio 304 that may be connected to the antenna 209. While illustrated as within the housing 207, the radio 304 may be located in other portions of the kite 101, such as in the wing 201, etc. The controller 301 may send and/or receive data to the radio 304 and via the radio 304 and antenna 209 may establish wireless communications with other devices, such as the command and control system 105. For example, the data sent to the command and control system 105 may be data received from the one or more instrument systems 305 and/or 306. As another example, the data received from the command and control system 105 may be data reflecting altitude and/or direction settings selected by an operator 104.

In an optional embodiment, the controller 301 may be connected to one or more stability support systems 310. The one or more stability support systems 310 may include sensors and/or devices configured to augment and/or assist the flight controls of the kite 101. As examples, the one or more stability support systems 310 may include accelerometers, gyros, etc., that may output data measurements to the controller 301. The controller 301 may use the data from the one or more stability support systems 310 as inputs to flight control logic to assist in controlling the orientation and/or operation of the kite 101.

The controller 301 may provide power from the power system 307 to the various components of the kite, such as the one or more instrument systems 305 and/or 306, the one or more actuators :302, the radio 304, and/or the one or more stability support systems 310, and/or the power system 307 may be connected to other components of the kite 101, such as the one or more instrument systems 305 and/or 306, the one or more actuators 302, the radio 304, and/or the one or more stability support system 310.

The controller 301 may control the operations of the actuators 302 to thereby actuate the one or more aerodynamic control surfaces, such as flaps 211 and 212, directional control surface 204, and/or lateral control surface 206 to adjust an attitude of the wing 201 and/or change a direction and/or orientation of the kite 101 while the kite 101 is aloft. Together, the controller 301, actuators 302, flaps 211 and 212, directional control surface 204, and/or lateral control surface 206 may constitute an aerodynamic surface control system configured to adjust the attitude of the wing 201. The controller 301 may control the operations of the actuators 302 to thereby actuate the one or more aerodynamic control surfaces, such as flaps 211 and 212, directional control surface 204, and/or lateral control surface 206 to perform various maneuvers with the kite 101, such as pointing the kite 101 into the wind, pointing the kite 101 ninety degrees to the wind, maintaining kite 101 level to the surface 106, causing the kite 101 to climb (thereby increasing the altitude "A"), causing the kite 101 to descend (thereby decreasing the altitude "A"), causing the kite 101 to keep station at a set altitude, etc. As the kite 101 may be independently controlled, the positioning of the kite 101 may be wind relative rather than surface 106 relative. The controller 301 may use the data received from the one or more instrument systems 305 and/or 306 as control inputs to guide the control of the actuators 302 and thereby control the actuation of the one or more aerodynamic control surfaces, such as flaps 211 and 212, directional control surface 204, and/or lateral control surface 206. For example, wind sensor data may be used to determine a direction and speed of the wind relative to the kite 101 by the controller 301, and the controller 301 may control the actuators 302 and thereby control the actuation of the one or more aerodynamic control surfaces, such as flaps 211 and 212, directional control surface 204, and/or lateral control surface 206 to turn the kite 101 into the wind and/or adjust the pitch of the wing 201 to achieve a desired lift force for the kite 101.

In optional configurations in which the one or more stability support systems 310 are present in the kite 101, together, the controller 301, actuators 302, flaps 211 and 212, directional control surface 204, lateral control surface 206, and/or the one or more stability support systems 310 may constitute the aerodynamic surface control system configured to adjust the attitude of the wing 201. In such optional configurations, the controller 301 may control the operations of the actuators 302 to thereby actuate the one or more aerodynamic control surfaces, such as flaps 211 and 212, directional control surface 204, and/or lateral control surface 206 to perform various maneuvers with the kite 101 based at least in part of data from the one or more stability support systems 310 (e.g., gyro data, accelerometer data, etc.). The controller 301 may use the data received from the one or more stability support systems 310 in concert with, or in place of, the data received from the one or more instrument systems 305 and/or 306 as control inputs to guide the control of the actuators 302 and thereby control the actuation of the one or more aerodynamic control surfaces, such as flaps 211 and 212, directional control surface 204, and/or lateral control surface 206. For example, gyro data may be used to determine an orientation of the kite 101 by the controller 301, and the controller 301 may control the actuators 302 and thereby control the actuation of the one or more aerodynamic control surfaces, such as flaps 211 and 212, directional control surface 204, and/or lateral control surface 206 to adjust the pitch of the wing 201 to maintain a selected orientation of the kite 101.

The operator 104 may set the desired heading and/or altitude "A" of the kite 101 using the command and control system 105. For example, via a wireless communication link between the command and control system 105 and the controller 301 established using the antenna 209 and radio 304, the command and control system 105 may send altitude "A"settings to the kite controller 301. Similarly, via a wireless communication link between the command and control system 105 and the controller 301 established using the antenna 209 and radio 304, the controller 301 may send data from the one or more instrument systems 305 and/or 306 to the command and control system 105. The adjustment of the attitude of the wing 201 by the controller 301 controlling the operations of the actuators 302 to thereby actuate the one or more aerodynamic control surfaces, such as flaps 211 and 212, directional control surface 204, and/or lateral control surface 206, may move the one or more instrument systems 305 and/or 306 from a first altitude to a second altitude, such as higher above the surface 106 or closer to the surface 106, as the kite 101 climbs or descends. Similarly, when the system 100 includes a suspended instrument system 107, the adjustment of the attitude of the wing 201 by the controller 301 controlling the operations of the actuators 302 to thereby actuate the one or more aerodynamic control surfaces, such as flaps 211 and 212, directional control surface 204, and/or lateral control surface 206, may move the suspended instrument system 107 from a first altitude to a second altitude, such as higher above the surface 106 or closer to the surface 106, as the kite 101 climbs or descends.

Figure 4:
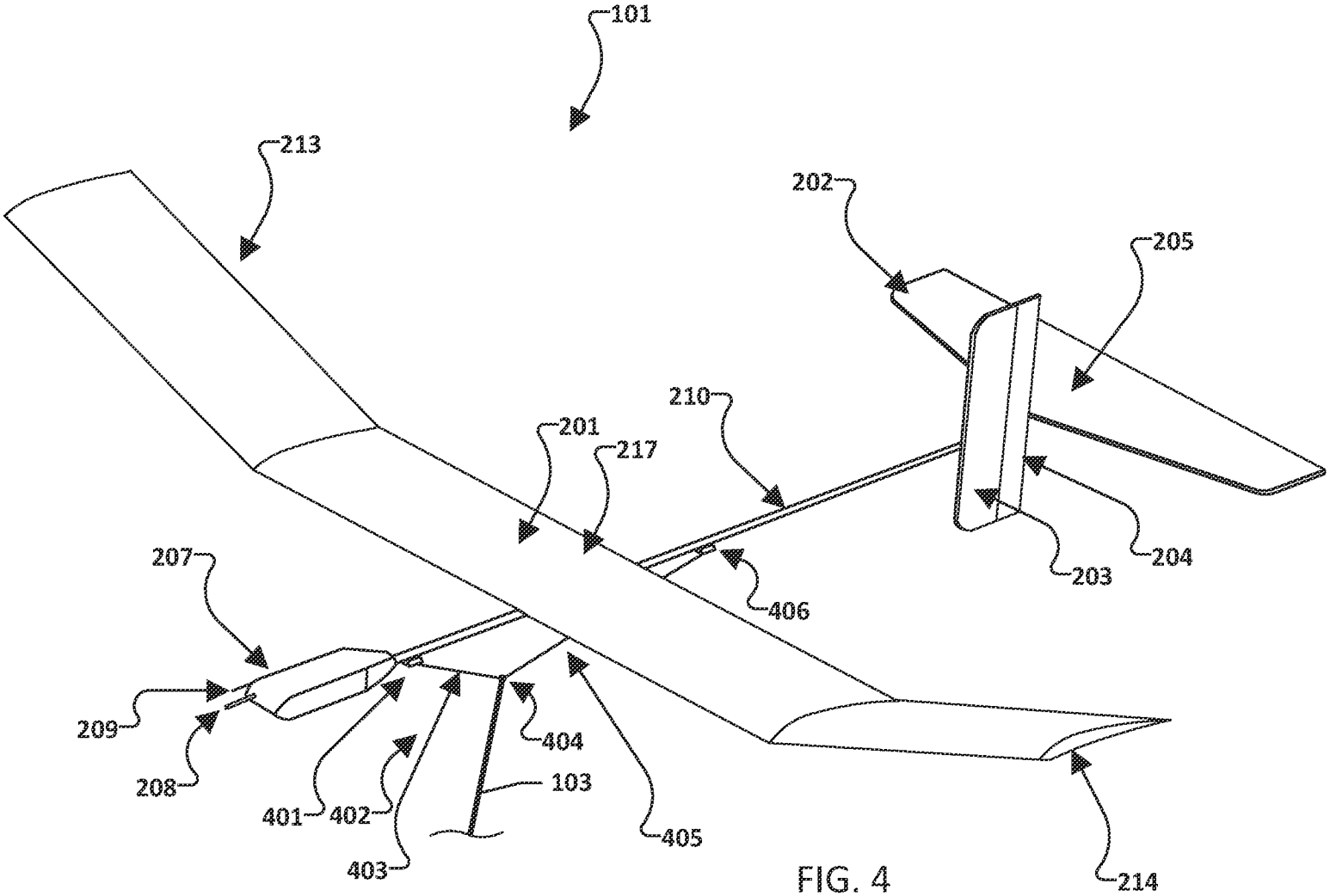
FIG. 4 is a block diagram of an embodiment kite haying a lifting surface and only a single flight line (or tether).

FIG. 4 is a block diagram of an alternative embodiment of a kite 101 in which an adjustable bridle system 402 may be actuated to adjust the attitude of the lifting surface, such as a wing 201. With reference to FIGS. 1-4, the adjustable bridle system 402 may eliminate a need for flaps, such as flaps 211 and 212, and/or a lateral control surface 206. The attachment point connecting the single tether 103 to the kite 101 may be a bridle ring 404 that is connected between bridle portions 403 and 405 of the adjustable bridle system 402. The adjustable bridle system 402 may be connected to the one or more actuators 302, and the actuators may control bridle tensioners 401 and 406 to adjust the lengths of bridle portions 403 and 405 to adjust the pivot of the bridle and thereby the attitude of the wing 201 (e.g., a pitch angle of the wing 201 with respect to the surface 106).

The processors described herein may be any programmable microprocessor, microcomputer or multiple processor chip or chips that can be configured by software instructions (applications) to perform a variety of functions, including the functions of the various embodiments described above. In some embodiments, multiple processors may be provided, such as one processor dedicated to wireless communication functions and one processor dedicated to running other applications. Typically, software applications may be stored in the internal memory before they are accessed and loaded into the processor. The processor may include internal memory sufficient to store the application software instructions. In many devices, the internal memory may be a volatile or nonvolatile memory, such as flash memory, or a mixture of both. For the purposes of this description, a general reference to memory refers to memory accessible by the processors including internal memory or removable memory plugged into the device and memory within the processors itself.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein. The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any, reference to claim elements in the singular, for example, using the articles "a," "an" or "the"is not to be construed as limiting the element to the singular.

What is claimed is:

1. A kite system, comprising:

a single tether; and a kite configured to operate aloft connected to only the single tether, the kite comprising:

a lifting surface, wherein the lifting surface is heavier-than-air;

an aerodynamic surface control system configured to adjust an attitude of the lifting surface while the kite is aloft;

an instrument system internal to the kite configured to gather data while the kite is aloft;

a power system located in the lifting surface of the kite system operably connected to the instrument system;

wherein the surface control system controls operation of one or more actuators to actuate one or more aerodynamic control surfaces includes a directional control surface, and a lateral control surface for adjusting an attitude of a lifting surface of the kite and for changing a direction and orientation of the kite while the kite is aloft; and an attachment point connecting the single tether to the kite.

2. The kite system of claim 1, wherein the lifting surface is a wing.

3. The kite system of claim 2, wherein the aerodynamic surface control system comprises at least one aerodynamic control surface that when actuated adjusts the attitude of the lifting surface.

4. The kite system of claim 2, wherein the kite further comprises a tail structure.

5. The kite system of claim 4, wherein the tail structure comprises at least one directional control surface and at least one lateral control surface controlled by the aerodynamic surface control system.

6. The kite system of claim 5, wherein the aerodynamic surface control system is configured to adjust a direction of the kite relative to a wind blowing on the kite while the kite is aloft.

7. The kite system of claim 2, wherein:

the aerodynamic surface control system comprises an adjustable bridle system that when actuated adjusts the attitude of the lifting surface; and the attachment point connecting the single tether to the kite connects to the adjustable bridle system.

8. The kite system of claim 1 , wherein the aerodynamic surface control system is configured to adjust the attitude of the lifting surface while the kite is aloft to move the instrument system from a first altitude to a second altitude.

9. The kite system of claim 8, wherein the instrument system comprises one or more of a wind sensor, a pressure sensor, a temperature sensor, and a humidity sensor.

10. The kite system of claim 1, further comprising:

a suspended instrument system affixed to the single tether, wherein the suspended instrument system is configured to gather data while the kite is aloft.

11. The kite system of claim 10, wherein the aerodynamic surface control system is configured to adjust the attitude of the lifting surface while the kite is aloft to move the suspended instrument system from a first altitude to a second altitude.

12. The kite system of claim 11, wherein the suspended instrument system comprises one or more of a wind sensor, a pressure sensor, a temperature sensor, and a humidity sensor.

13. The kite system of claim 1, wherein the aerodynamic surface control system includes at least one stability support system.

* * * * *